US006120621A

United States Patent [19]

Jin et al.

[11] Patent Number: 6,120,621

[45] **Date of Patent: *Sep. 19, 2000**

[54] CAST ALUMINUM ALLOY FOR CAN STOCK AND PROCESS FOR PRODUCING THE ALLOY

[75] Inventors: Iljoon Jin; John Fitzsimon, both of Kingston, Canada

[73] Assignee: Alcan International Limited, Montreal, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/676,794

[22] Filed: Jul. 8, 1996

[51] Int. Cl.[7] ..... C22C 21/00

[52] U.S. Cl. ..... 148/437; 148/418; 148/417; 148/416; 148/415; 148/439; 420/535; 420/534

[58] Field of Search ..... 148/418, 417, 148/416, 415, 439; 420/535, 534

[56] References Cited

U.S. PATENT DOCUMENTS

| | | |
|---|---|---|
| 3,930,895 | 1/1976 | Moser et al. . |
| 4,111,721 | 9/1978 | Hitchler et al. . |
| 4,163,665 | 8/1979 | Pearson . |

(List continued on next page.)

FOREIGN PATENT DOCUMENTS

| | | |
|---|---|---|
| 576170A1 | 6/1993 | European Pat. Off. . |
| 576171A1 | 6/1993 | European Pat. Off. . |
| 2810188 | 9/1979 | Germany . |
| 58-126967 | 7/1983 | Japan . |
| 2025539 | 1/1990 | Japan . |
| 2080542 | 3/1990 | Japan . |
| 6081087 | 3/1994 | Japan . |
| 6136491 | 4/1994 | Japan . |
| 6346205 | 12/1994 | Japan . |
| 7256416 | 10/1995 | Japan . |
| 7290206 | 11/1995 | Japan . |
| 2172303 | 9/1986 | United Kingdom . |

OTHER PUBLICATIONS

Westerman, E.J., "Silicon: A Vital Alloying Element . . . " (*Aluminum Alloys for Packaging*, ed. J.G. Morris et al. (1993), pp. 1–15.

Naess, S. E., "Earing and Texture in Strip–Cast 3004 Type Alloys," *Aluminum Alloys for Packaging*, ed. J.G. Morris et al. (1993) , pp. 275–298.

P. Vangala et al., "The Influence of Casting Gauge on the Hunter Roll Casting Process," *Melt–Spinning and Strip Casting*, ed. E.R. Matthys (1992), pp. 225–241.

Spear, R.E. and G.R. Gardner. "Dendrite Cell Size." Transactions of the American Foundrymen's Society. 71 (1964): 209–215.

Field, Michael, John F. Kahles, and William P. Koster. "Surface Finish and Surface Integrity." *Metals Handbook*. 9th ed. 16 (1989):19–23.

*Primary Examiner*—Patrick Ryan
*Assistant Examiner*—M. Alexandra Elve
*Attorney, Agent, or Firm*—Cooper & Dunham LLP

[57] ABSTRACT

An aluminum alloy strip useful for can stock having a thickness of less than or equal to about 30 mm, and containing large $(Mn,Fe)Al_6$ intermetallics as principal intermetallic particles in said strip. The intermetallic particles have an average surface size at a surface of the strip and an average bulk size in a bulk of the strip, the average surface size being greater than the average bulk size. The strip article may be produced by supplying a molten aluminum alloy having a composition consisting, in addition to aluminum, essentially by weight of: Si between 0.05 and 0.15%; Fe between 0.3 and 0.6%; Mn between 0.6 and 1.2%; Mg between 1.1 and 1.8%; Cu between 0.2 and 0.6%; and other elements: less than or equal to 0.05% each element with a maximum of 0.2% for the total of other elements; and casting the molten alloy in a continuous caster having opposed moving mold surfaces to an as-cast thickness of less than or equal to 30 mm. The moving mold surfaces have a surface roughness of between 4 and 13 microns, substantially in the form of sharp peaks, and heat flux is extracted from the metal at a rate that results in the production of an interdendritic arm spacing of between 12 and 18 microns at the surface of said strip. The strip may then be processed to final thickness by means of rolling and annealing steps.

25 Claims, 7 Drawing Sheets

U.S. PATENT DOCUMENTS

| | | | |
|---|---|---|---|
| 4,235,646 | 11/1980 | Neufeld et al. . | |
| 4,238,248 | 12/1980 | Gyongyos et al. | 148/2 |
| 4,260,419 | 4/1981 | Robertson . | |
| 4,269,632 | 5/1981 | Robertson et al. | 148/2 |
| 4,282,044 | 8/1981 | Robertson et al. . | |
| 4,411,707 | 10/1983 | Brennecke et al. | 148/2 |
| 4,471,032 | 9/1984 | Fukuoka et al. | 428/653 |
| 4,614,224 | 9/1986 | Jeffrey et al. . | |
| 4,976,790 | 12/1990 | McAuliffe et al. . | |
| 5,104,459 | 4/1992 | Chen et al. | 148/11.5 |
| 5,104,465 | 4/1992 | McAuliffe et al. . | |
| 5,106,429 | 4/1992 | McAuliffe et al. . | |
| 5,110,545 | 5/1992 | McAuliffe et al. . | |
| 5,441,582 | 8/1995 | Fujita et al. | 148/693 |

ROLLING DIRECTION

SURFACE

INTERIOR

ROLLING DIRECTION

SURFACE

INTERIOR

ROLLING DIRECTION

SURFACE

INTERIOR

CAST ALUMINUM ALLOY FOR CAN STOCK AND PROCESS FOR PRODUCING THE ALLOY

BACKGROUND OF THE INVENTION

I. Field of the Prior Art

This invention relates to a cast aluminum alloy product suitable for making can stock, and to a process for making the product. It also relates to an alloy sheet product suitable for making cans, and to a process for making the product.

II. Description of the Prior Art

Aluminum beverage cans are made from sheet-form alloys such as alloys designated as AA3004, AA3104 and similar alloys containing Mg, Mn, Cu, Fe and Si as principal alloying elements. The sheet is generally made by direct chill (DC) casting an ingot (typically 500 to 750 mm thick) of the desired composition, homogenizing the ingot at temperatures of 580 to 610° C. for periods of 2 to 12 hours, and hot rolling the ingot (employing a mill entry temperature of about 550° C.), thereby reducing it to re-roll sheet of about 2 to 3.5 mm thick. The re-roll sheet is then cold rolled in one or more steps to the final gauge (0.26 to 0.40 mm). Various annealing steps may be used in conjunction with the cold rolling.

The alloy and processing conditions are selected to give sufficiently high strength, high galling resistance (also referred to as scoring resistance) and low earing to enable fabrication of a can body by drawing and ironing (D&I) operations, and sufficiently high strength retention after paint baking that the finished can is adequately strong. The galling resistance is believed to be related to the presence of intermetallic particles dispersed throughout the ingot, which remain in the final rolled product. It is commonly found that homogenization of a DC cast ingot of suitable composition develops enlarged α-Al(Fe,Mn)Si (alpha) phase particles which are believed to prevent galling, although there is also evidence (e.g., see Japan patent publication JP 58-126967) to suggest that the formation of $(Mn,Fe)Al_6$ intermetallic particles during homogenization provides the necessary galling resistance.

The use of continuous casting to produce alloy slab (typically 30 mm in maximum thickness) followed by hot rolling the slab directly (essential in a continuous process without homogenization) to make re-roll sheet has decided advantages in the production of sheet products, in that hot rolling can be carried out without having to reheat a large DC cast ingot. Such a process is disclosed, for example, in U.S. Pat. No. 4,614,224 which teaches the importance of fine alpha phase particles in can performance, but not specifically for imparting galling resistance.

However, when such a continuous process is used as the initial step in producing a final sheet suitable for can production, the properties required for modern can production cannot all be met in the way that DC cast material meets these requirements. Such continuously cast material generally has excessive earing and excessive galling or scoring during can making operations.

Strip cast can body stock material has been produced with large particles distributed through the slab, but only by incorporating a homogenization step prior to hot rolling, as in DC casting.

British Patent GB 2 172 303 discloses strip cast can stock material in which alpha phase particles are generated and grown to a suitable size to prevent galling using homogenization of the cast strip.

U.S. Pat. No. 4,111,721 discloses strip cast material in which homogenization is also used to grow $(Mn,Fe)Al_6$ particles above a size suitable to prevent galling.

Both of these continuous casting processes have the disadvantage of requiring an homogenization step to achieve the desired effect. This must be carried out on a coil, and temperature control is critical to avoid excessive oxidation of the coil and adhesion of the coil layers to each other. Furthermore the addition of such a step removes much of the cost advantage present in a continuous process.

In all previously developed processes which generate large intermetallics suitable for prevention of scoring, the process generates large intermetallics throughout the strip, whereas the large intermetallics are of value in preventing galling only at the surface of the strip. Elsewhere they may be detrimental.

There is a need therefore for a strip making process based on a continuous casting process which is capable of producing a strip having properties meeting modern can and can fabrication requirements, which is made cost effective through the elimination of certain process steps (such as homogenization) previously considered essential.

SUMMARY OF THE INVENTION

An object of the present invention is to provide a cast slab product suitable for hot and cold rolling to can stock having the necessary properties for making cans.

Another object of the invention is to provide a process for continuous casting a slab suitable for hot and cold rolling to can stock.

Another object of the invention is to provide a re-roll sheet product suitable for cold rolling to can stock.

Another object of the invention is to provide a sheet product suitable for making can bodies by a D&I operation.

Yet another object of the invention is to provide a process for making a sheet product suitable for making can bodies by a continuous casting process which does not require homogenization.

In a first embodiment of the invention, there is provided an aluminum alloy strip having a thickness of less than or equal to about 30 mm, and containing large $(Mn,Fe)Al_6$ intermetallics as principal intermetallic particles in the strip. The intermetallic particles have an average particle size at the surface of the strip and an average particle size in the bulk of the strip, wherein the average particle size at the surface of the strip is greater than the average particle size in the bulk.

The strip may be in the form of a continuously cast strip, or a rolled strip preferably less than or equal to 5 mm thick. When the strip is a rolled strip, it will have preferably been produced without an homogenization process from a continuously cast strip. The rolled strip may be a hot rolled strip, preferably between 0.8 and 5.0 mm in thickness, or a cold rolled strip. The cold rolled strip may preferably be formed by a rolling process selected from (a) hot rolling to form a re-roll strip between 0.8 and 1.5 mm thick, annealing the re-roll strip by an annealing method selected from batch annealing, self annealing and continuous annealing, and cold rolling the re-roll strip to final gauge using between 70 and 80% reduction, and (b) hot rolling to a re-roll strip between 1.5 and 5.0 mm thick, cold rolling the re-roll strip to produce an intermediate gauge strip of between 0.6 and 1.5 mm in thickness, annealing the intermediate gauge strip by an annealing method selected from batch annealing and continuous annealing, and cold rolling the intermediate gauge strip to final gauge using between 45 and 70% reduction.

In another embodiment of the invention, there is provided a process comprising the steps of supplying a molten aluminum alloy, casting said molten alloy in a continuous caster having opposed moving mould surfaces to an as-cast thickness of less than or equal to 30 mm, wherein said moving mould surfaces have a surface finish selected from the group consisting of (a) a surface roughness of between 6 and 16 microns ($R_a$) and (b) a surface roughness of between 4 and 6 microns ($R_a$) where said surface roughness is substantially in the form of sharp peaks, and wherein heat is extracted from the metal at a rate that produces a secondary dendrite arm spacing of between 12 and 18 microns at the surface of the said strip.

This cast strip may be further processed by rolling to a thinner gauge, this rolling process preferably being done without homogenization. The rolling process may be selected from the group consisting of (a) hot rolling to form a re-roll strip between 0.8 and 1.5 mm thick, annealing said re-roll strip by an annealing method selected from the group consisting of batch annealing, self annealing or continuous annealing, cold rolling the re-roll strip to final gauge using between 70 and 80% reduction or (b) hot rolling to a re-roll strip between 1.5 and 5.0 mm thick, cold rolling the re-roll strip to produce an intermediate gauge strip of between 0.6 and 1.5 mm thickness, annealing the intermediate gauge strip by an annealing method selected from the group consisting of batch annealing or continuous annealing, cold rolling the intermediate gauge strip to final gauge using between 45 and 70% reduction.

In yet another embodiment of the invention, there is provided a process comprising the steps of continuously casting an aluminum alloy slab to a thickness of less than or equal to 30 mm, rolling said slab without homogenization to final gauge by a process selected from (a) hot rolling to form a re-roll strip between 0.8 and 1.5 mm thick, annealing said re-roll strip by an annealing method selected from annealing, self annealing or continuous annealing, and cold rolling the re-roll strip to final gauge using between 70 and 80% reduction, or (b) hot rolling to a re-roll strip between 1.5 and 5.0 mm thick, cold rolling the re-roll strip to produce an intermediate gauge strip of between 0.6 and 1.5 mm thickness, annealing the intermediate gauge strip by an annealing method selected from batch annealing or continuous annealing, and cold rolling the intermediate gauge strip to final gauge using between 45 and 70% reduction.

In the rolling process described as process (a) above, the re-roll strip is preferably between 1 and 1.3 mm in thickness, and the re-roll strip is rolled to final guage using preferably between 75 and 80% reduction.

The particle size of $(Fe,Mn)Al_6$ intermetallics of this invention are determined as follows. In the as-cast strip, the particles are frequently in the form of elongated particles. The size is characterized by the thickness of these particles. Such thicknesses are most easily determined by optical examination of metallographic sections. In the rolled sheet, the elongated particles become broken down into much shorter particles of approximately the same thickness as the original particles, or equiaxed particles having dimensions approximately the same as the original particle thickness. In rolled sheet where particles are more nearly equiaxed, particle sizes can be determined using quantitative metallographic techniques for example using an image analysis system operating with Kontron® IBAS software. The size of particles in the rolled sheet is still characteristically the thickness of the particles.

The surface roughness value ($R_a$) is the arithmetic mean surface roughness. This measurement of roughness is described for example in an article by Michael Field, et al., published in the Metals Handbook, Ninth Edition, Volume 16, 1989, published by ASM International, Metals Park, Ohio 44073, USA, pages 19 to 23; the disclosure of which is incorporated herein by reference. The surface roughness is preferable less than or equal to 13 microns.

Measurement of surface roughness can be made with commercially available equipment such as the Wyko RST-Plus® profilometer, which generates not only surface topography plots but also calculates then roughness facts (arithmetic, RMS, etc).

The secondary dendrite arm spacing is described along with standard methods of measurement for example in an article by R. E. Spear, et al., in the Transactions of the American Foundrymen's Society, Proceedings of the Sixty-Seventh Annual Meeting, 1963, Vol 71, Published by the American Foundrymen's Society, Des Plaines, Ill., USA, 1964, pages 209 to 215; the disclosure of which is incorporated herein by reference.

The present invention is capable of producing a can stock having substantially all of the desirable properties for can formation as can stock produced by DC methods.

DETAILED DESCRIPTION OF THE INVENTION AND THE PREFERRED EMBODIMENTS

Figure 1A:
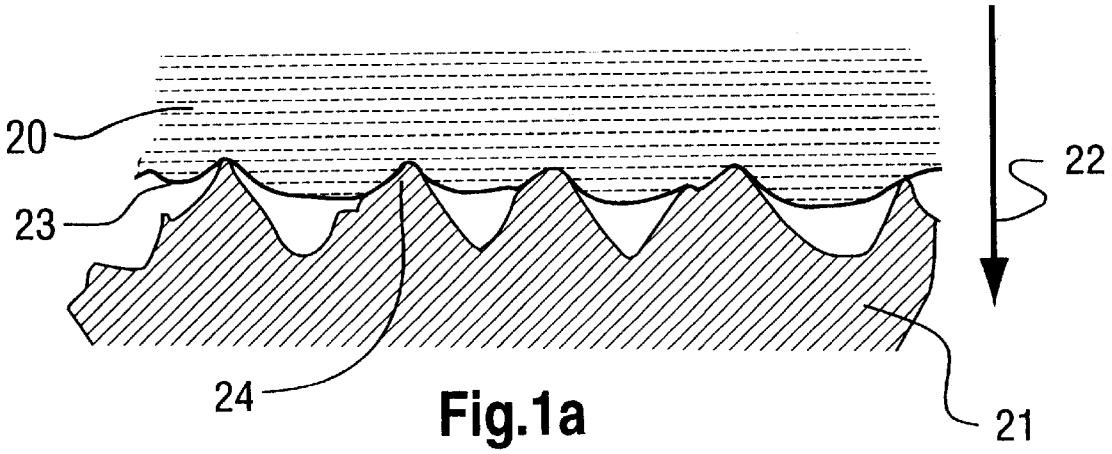
FIG. 1*a*, 1*b* and 1*c* are each schematic cross-sections of a casting surface-metal interface of this invention at different stages during solidification showing the process which is believed to be occurring.

It is preferred that the aluminum alloy of the present invention have a composition (in addition to aluminum) in percent by weight consisting essentially of:

| | |
|---|---|
| Si | between 0.05 and 0.15% |
| Fe | between 0.3 and 0.6% |
| Mn | between 0.6 and 1.2% |
| Mg | between 1.1 and 1.8% |
| Cu | between 0.2 and 0.6% |
| other elements: | less than or equal to 0.05% each element with a maximum of 0.2% for the total of other elements. |

It is more preferred that the manganese concentration lies between 0.7 and 1.2%, that the silicon concentration lies between 0.07 and 0.13%, that the magnesium concentration lies between 1.2 and 1.6%, and that the copper lies between 0.2 and 0.5%. It is also preferred that the other elements include Cr, Zr, and V at concentrations of less than or equal to 0.03% each.

It is preferred that the $(Mn,Fe)Al_6$ intermetallics comprise at least 60% on a volume basis of the intermetallics present. These intermetallics are those which form during the initial solidification of the alloy strip on casting and remain in the rolled sheet, broken into shorter particles as described above, and are observable using optical microscopy methods. It is further preferred that the average particle size (measured as described above) of the intermetallics at the surface be at least 1.5 times greater that the average particle size of the intermetallics in the bulk.

It is further preferred that the cast strip of the above embodiments be between 9 and 25 mm thick. The secondary dendrite arm spacing at the surface of the as-cast strip of the above embodiments is preferably between about 12 and 18 microns, and most preferably between 14 and 17 microns. The as-cast strip also has a surface segregated layer and the average surface size of intermetallics is taken as the average size within this layer, and the average bulk size is taken as the average size outside this layer. The concentration of intermetallics is also preferably higher at the surface than in the bulk of the cast strip. The intermetallics in the surface segregated layer of the as-cast strip have a size, defined by their thickness, of about 2 to 15 microns. The particles may be 10 to 100 microns in length. The surface segregated layer is preferably about 10 to 100 microns in thickness but more preferable between 30 to 60 microns in thickness. The surface of the as-cast strip has a structure comprising needle shaped intermetallics. The as-cast strip is preferably free of porosity.

The surface segregated layer is a layer in which the concentrations of the principal alloying elements (Si, Fe, Mn, Mg and Cu) are higher than in the rest of the strip.

The casting process is carried out on a surface that has a roughness preferably of at least 6 microns and preferably created by sand or shot blasting a metal casting surface or by application of a coating to a metal casting surface (plasma sprayed ceramic or metal coatings may be used). Such a surface preferably has sharp peaks in the roughened area. These may become worn down in use or via some secondary honing or grinding operation. When worn down, honed or ground, the peaks become flattened and do not provide the preferred casting surface unless the overall roughness is at least 6 microns. The surface roughness may be as low as 4 microns provided that the surface has sharp peaks. Such a surface is preferably created by sand or shot blasting a metal casting surface Preferably, the slab is cast using a twin belt caster such as one described in U.S. Pat. No. 4,061,177, the disclosure of which is incorporated by reference. Such a caster may use shot or sand blasted metal belts or may use ceramic coated metal belts with the desired roughness characteristics.

The rolled strip has intermetallic particles of an average surface size in the range from 2 to 10 microns present after rolling (either hot or cold rolling) measured as described above. The average bulk size is taken as the average size at the centre of the rolled strip.

The continuous annealing step of the above embodiments preferably consists of annealing at a temperature of 500 to 550° C. for 10 to 180 seconds followed by quenching to room temperature within about 120 seconds. The batch annealing step consisted of annealing at a temperature of between 400 to 450° C. for 0.25 to 6 hours. This represents the soaking time at temperature and excludes the time to heat up the coil and cool the coil after annealing. The self annealing step comprising coiling the strip after hot rolling at a temperature of at leat 400° C. and allowing the coil to cool naturally to room temperature. It is particularly preferred that batch annealing be used in the above embodiments.

The final gauge strip after cold rolling is preferably between 0.26 and 0.40 mm in thickness. In the final gauge, the intermetallics are preferably present at a surface density of about 7500 particles/$mm^2$. The final gauge strip has a 45° earing of less than about 3%, an elongation of greater than about 4%, a yield strength after stoving at 195° C. for 10 minutes of at least 36 ksi, and preferably at least 39 ksi. The final strip can be subjected to a drawing and ironing operation with substantially no galling. Thus the final gauge strip meets the requirements of modern cans and the can fabrication process.

Galling resistance refers to the ability to run the can body stock through a D&I can making apparatus for extended periods of time without the development of surface scratches or similar flaws forming on the can body surface. Such flaws are caused by a buildup of debris on the dies used in the operation. The final gauge strip of the present invention showed little such galling behaviour even after up to 50,000 can making operations.

The Roles of the Alloying Elements

Silicon

Silicon at less than 0.15% by weight (and preferably less than 0.13% by weight) ensures that the principal intermetallic phase formed is the $(Mn,Fe)Al_6$ phase, (with only minor amounts of the Al-Fe-Mn-Si alpha phase present) when the casting is carried out with a sufficiently low heat flux. If Si exceeds 0.15% by weight, the alpha phase begins to dominate even at low heat fluxes. The lower limit of Si of 0.05% by weight (preferably 0.07% by weight) represents a practical lower limit represented by the commercial availability of Al metal.

Manganese

Manganese within the claimed range ensures adequate strength in the final product after stoving and ensures an adequate number of the desired intermetallics are formed. If Mn exceeds the upper limit, too many dispersoids (very fine particles) form which causes excessive earing in the final product. If Mn is less than the lower limit, the final product lacks strength after stoving and insufficent intermetallic particles are formed to prevent galling in the final product.

Iron

Iron with the claimed range ensures an adequate number of intermetallic particles of the desired (Mn,Fe) $Al_6$ composition, and provides control of the cast grain structure. If Fe is too low, the cast grain size is too large and difficulties occur during rolling. If Fe is too high earing performance becomes poor. Manganese and iron can substitute for one another in the intermetallics present in largest number in this invention. It is preferred however that the intermetallics have a size and shape characteristic (morphology) of the manganese based intermetallic and therefore the manganese to iron ratio in the alloy preferably exceeds 1.0 and most preferably exceeds 2.0. If iron dominates the intermetallics become finer and are less desirable.

Magnesium

Magnesium within the claimed range, along with copper and manganese provide adequate strength in the final product. Magnesium, along with copper, influences the freezing range of the alloy and thereby the formation of the surface segregated layer in the cast solid. If magnesium is too high, the final product will undergo excessive work hardening during drawing and ironing and can result in higher galling than is desirable. If magnesium is too low, the final product will have insufficient strength Copper Copper within the claimed range contributes to the strength of the product, and because it operates by a precipitation hardening mechanism, contributes to the retention of strength after stoving. It also contributes along with magnesium to the freezing range of the alloy and hence control of the surface segregation zone. If copper is to high, the final product will be susceptible to corrosion. If copper is too low, the amount of precipitation hardening will be insufficient to achieve the desired stoved strength.

Chromium, Vanadium and Zirconium

Theses elements increase the thermal stability of the alloy and if present in excess will upset earing control. They should preferably be less than 0.03%.

Heat Flux and Casting Surface Roughness

Although not wishing to be bound by any theory, it is believed that when a can alloy which contains Fe, Mn and Si in the range claimed is continuously cast in a caster operating within a heat flux range such that the surface secondary dendrite arm spacing lies between 12 and 18 microns, the formation of (Mn,Fe)$Al_6$ intermetallics is enhanced significantly over the α-Al(Fe,Mn)Si (alpha phase). These intermetallics form a blocky particles throughout the cast slab.

In the event that the mould surface is adequately roughened then intermetallics form as larger particles at the surface than in the bulk of the metal. If the roughness ($R_a$) exceeds about 6 microns, the type of roughness is less important in achieving this effect, although it is preferred that the roughness surface texture have a positive or zero skew and consist of sharp (rather than rounded) peaks. At lower roughness (down to $R_a$ of about 4 microns) the form of the roughness becomes more critical and a zero or positive skew with sharp peaks becomes an essential feature.

Figure 3:
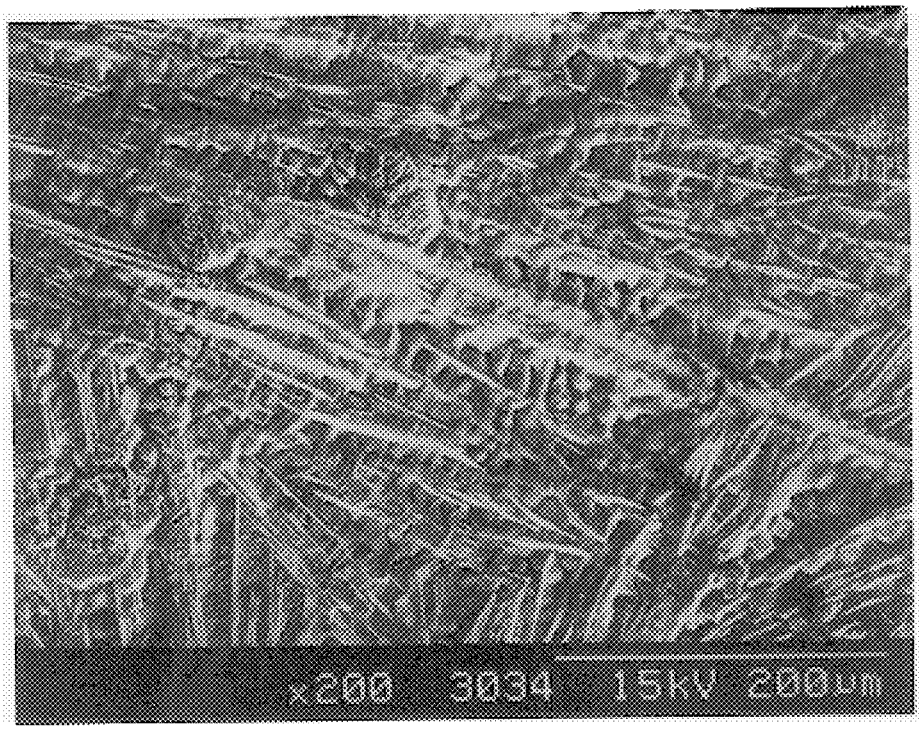
FIG. 3 is a micrograph at 200×magnification showing the surface of a cast strip according to this invention.

The skewness of the surface texture is defined, for example by J. F. Song and T. V. Vorbuger, Surface Texture in the ASM Handbook, Volume 18, Pages 334 to 345, published 1992; the disclosure of which is incorporated herein by reference. A typical zero skewed, but sharp peaked surface is shown in FIG. 3(*c*) of that article.

Figure 1B:
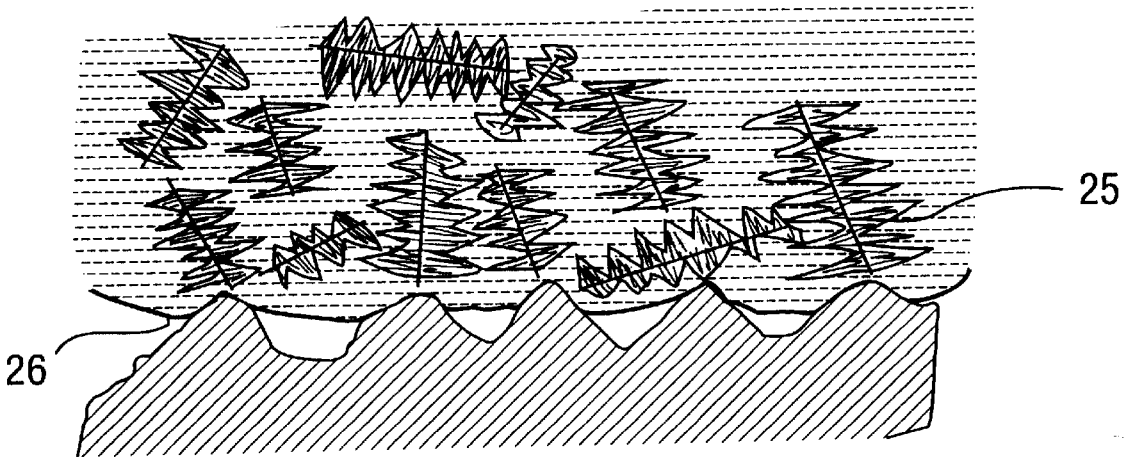
Figure 1C:
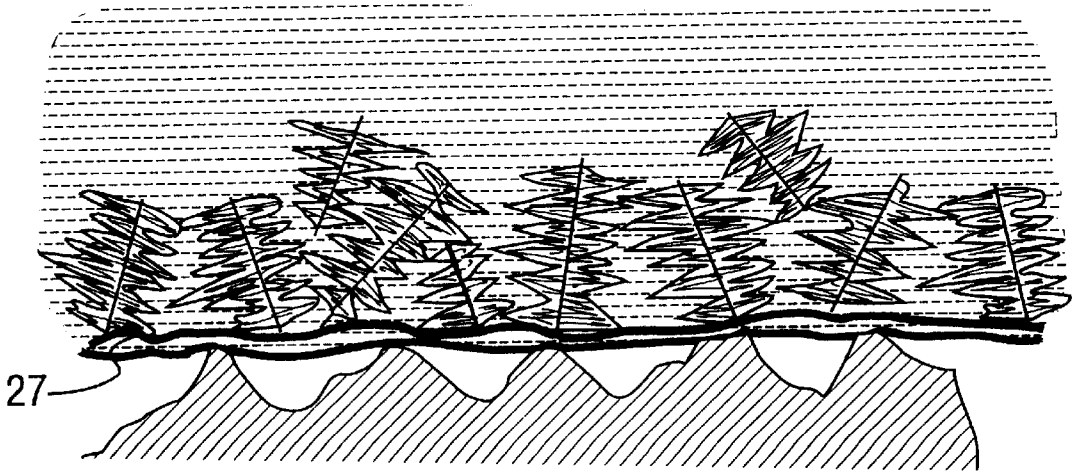

FIGS. 1*a,* 1*b* and 1*c* illustrate the effect of surface roughness on the solidification process. In FIG. 1*a* the initial contact between the metal 20 and the mould surface 21 is illustrated. Heat is removed in the direction of the arrow 22. The contact between the metal 23 and the surface roughness 24 is highly localized. As the metal slab begins to solidify as shown in FIG. 1*b* it forms aluminum dendrites 25 with interdendritic liquid and shrinks away from these localized points 26. The surface layer then undergoes a re-heating process as shown in FIG. 1*c*. This reheating causes the exudation of solute enriched interdentritic liquid at the surface 27 in a uniform manner. Such processes are normally undesirable as they produce a substantial segregated layer at the surface. The use of smooth surfaces or surface of low roughness or where the sharp peaks are reduced by some polishing, grinding or honing process is often used to minimize such segregated layers. Such surface roughness is said to have negative skew. In DC casting, surface segregated layers are routinely scalped from the surface before hot rolling. Casting processes, either DC or continuous, are generally carried to produce a minimum segregated layer thickness. In this invention, the process of forming a surface segregated layer is encouraged in order to cause the formation of a substantially increased number of (Mn,Fe)$Al_6$ intermetallics in this surface zone, and by ensuring that the cooling rate is adequately slow and the freezing range sufficiently large, that intermetallics are caused to grow to a larger size than in the bulk of the material. The surface segregation zone is also affected by the freezing range of the alloy, and use of Cu and Mg in the range claimed ensures that an adequate freezing range is obtained to properly allow the desirable surface segregation zone to form.

Because the slab is processed without homogenization, there is no further change in intermetallics. Thus the enhanced intermetallic (Mn,Fe)$Al_6$ sizes at the surface are retained through both hot rolling and cold rolling resulting in a re-roll and final gauge product that has larger intermetallics sizes on the strip surface than in the centre and provides excellent galling resistance when used in D&I can making operations. As the intermetallics present in the final gauge product principally affect galling resistance (also referred to as scoring resistance), the presence of the desirable larger particles at the surface rather than the bulk is an advantage. Unless the appropriate larger surface intermetallics are created during the casting process, they cannot be subsequently generated.

If the heat flux is lower than that desired to give the indicated surface cooling rate and secondary dendrite arm spacing and if the surface roughness ($R_a$) exceeds about 13 microns, this is believed to cause porosity in the cast product although the desired intermetallics form. However roughness ($R_a$) exceeding 16 microns produces completely unacceptable porosity and growth of intermetallics beyond that which is desirable for useful can stock. If the heat flux exceeds that required to give the desired secondary dendrite arm spacing, alpha phase formation is enhanced, and if in addition the surface roughness is less than that claimed, the surface segregation zone does not form and the desirable surface size of intermetallics cannot be formed.

The hot rolling and anneal conditions are believed necessary to alter the crystalline form of the grains to "cube" texture, which is important to ensure low 45° earing in the final product sheet. The balance between the mechanical work and thermal treatment is necessary to generate the desired earing. Whilst a number of such processes may be used, a combination of increased hot rolling reduction and slow heating during annealing produces the best results and is believed to reduce the earing to the greatest extent in the present case.

The invention is described in more detail in the following Examples. These Examples are not intended to limit the scope of the present invention but merely provide illustrations.

EXAMPLE 1

Figure 2:
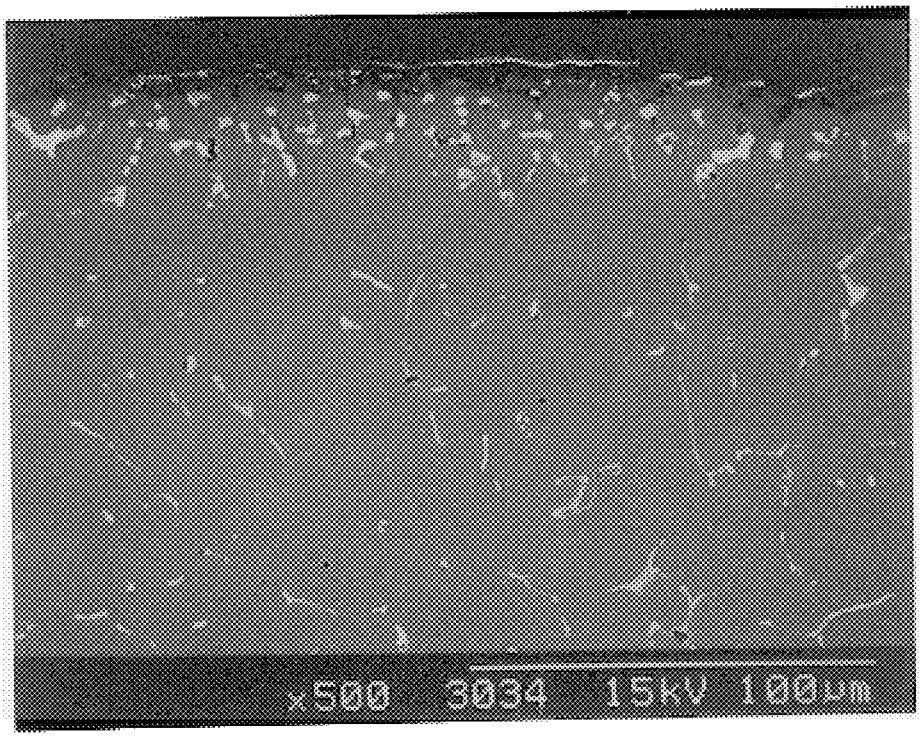
FIG. 2 is a micrograph at 500×magnification showing a cross-section near the surface of a cast strip according to this invention.

An aluminum alloy of composition 0.10% Si, 0.91% Mn, 0.32% Fe, 0.43% Cu, 1.48% Mg was cast to a thickness of 15.4 mm on a commercial twin belt caster having steel belts roughened by shot blasting. The belt roughness ($R_a$) was 12.3 microns. A heat flux of 2.1 $MW/m^2$ was used along the portion of the belt caster in which solidification took place. A sample of the as-cast strip was taken and examined microscopically. A micrograph of a cross section of the cast strip is shown in FIG. 2. In FIG. 2 a surface segregated layer of thickness about 30 microns in thickness can be observed. The secondary dendrite arm spacing in this layer is about 15.3 microns. The intermetallics are of the $(Mn,Fe)Al_6$ type and are about 4.2 microns in size (thickness as defined above) in this surface layer. The bulk of the strip is separated from the surface layer by a small denuded zone. Within the bulk of the strip, the intermetallics are of the same type but have an average size (thickness) of about 1.8 microns. The surface of the cast strip is shown in a micrograph in FIG. 3. The intermetallics of the above composition are present in the form of needle-shaped crystals.

Figure 4A:
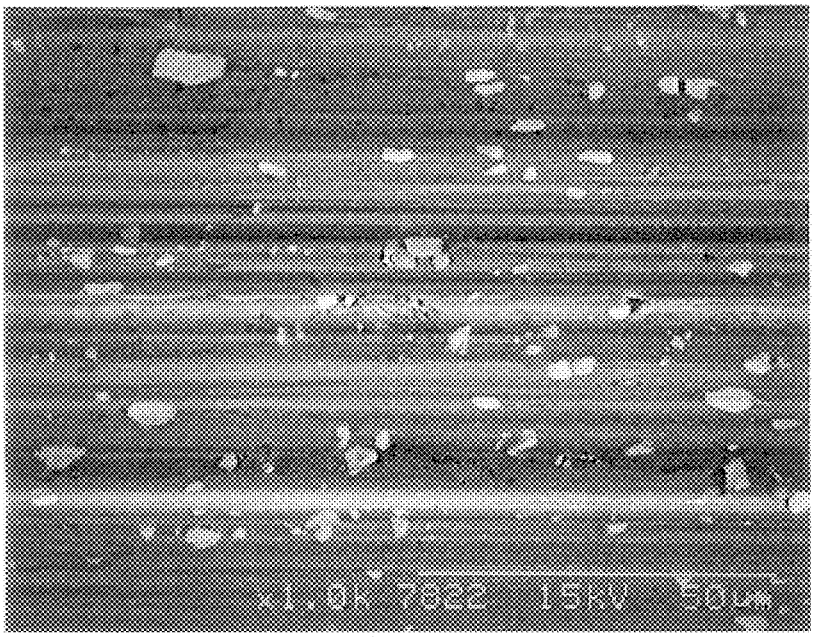
FIGS. 4A and 4B are micrographs at 1000×magnification showing the surface (FIG. 4A) and interior (FIG. 4B) of a strip of the present invention after rolling to final gauge.
Figure 4B:
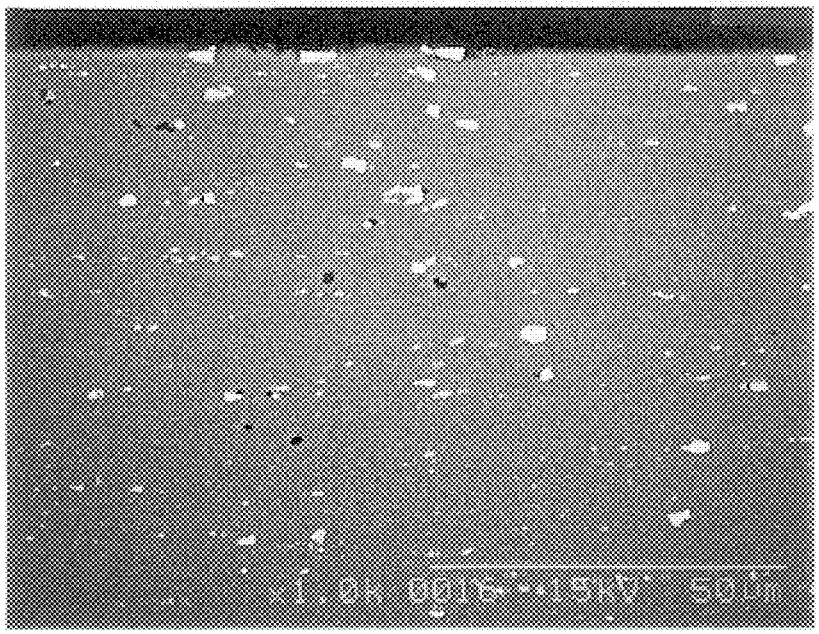
Figure 5A:
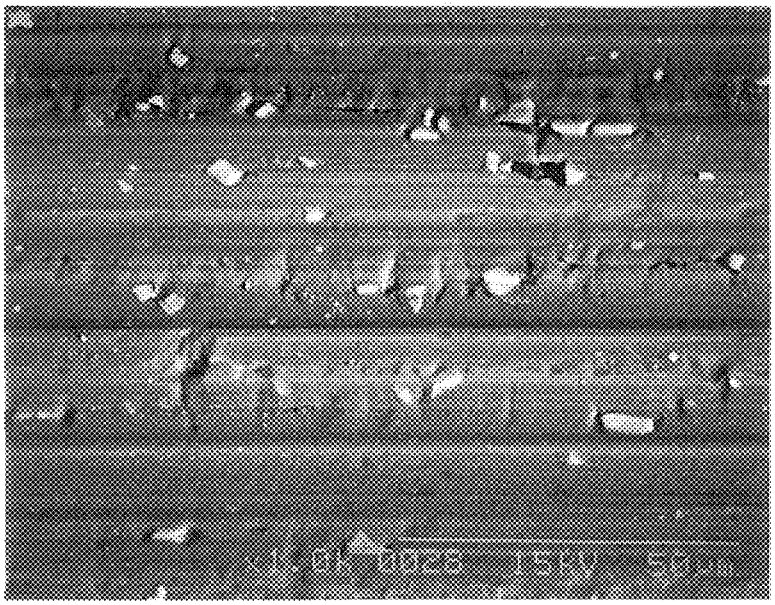
FIGS. 5A and 5B are micrographs at 1000×magnification showing the surface (FIG. 5A) and interior (FIG. 5B) of a strip of can body stock prepared by DC casting, scalping, homogenization, hot and cold rolling to final gauge.
Figure 5B:
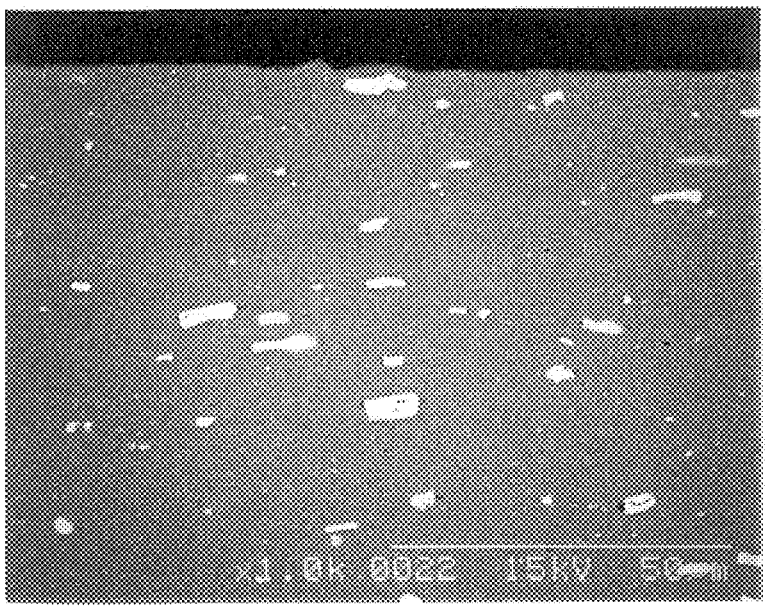
Figure 6A:
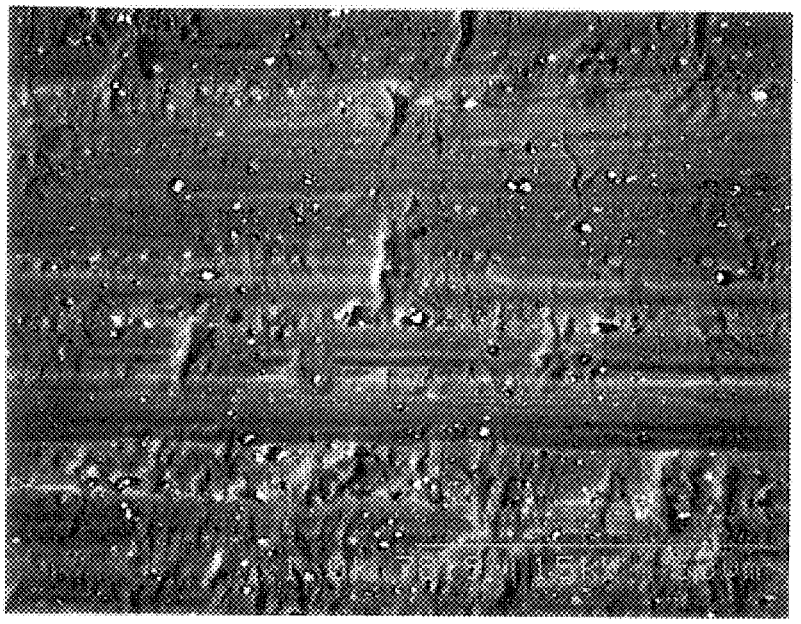
FIGS. 6A and 6B are micrographs at 1000×magnification showing the surface (FIG. 6A) and interior (FIG. 6B) of a strip of can body stock prepared by a prior art method and cold rolling to final gauge.
Figure 6B:
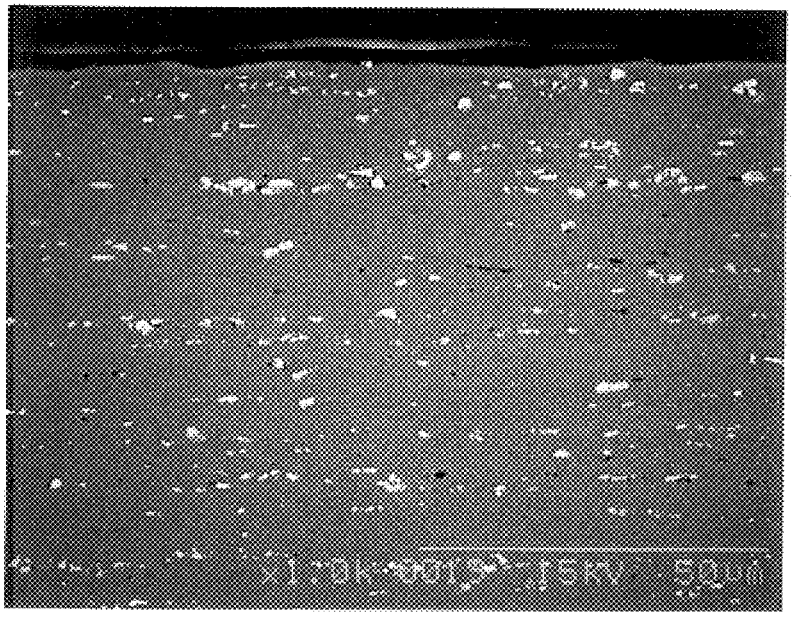

The above slab was then rolled through a two stand hot mill to a re-roll gauge of 2.3 mm and coiled. The coil was annealed at 425° C. for 2 hours then cold rolled to an intermediate gauge of 0.8 mm, inter-annealed at 425° C. for 2 hours, then cold rolled to a final gauge of 0.274 mm. A sample of the final gauge material was taken and a micrograph is shown in FIGS. 4A and 4B. The surface has $(Mn,Fe)Al_6$ particles with a size, measured by quantitative metallographic techniques of 3.5 microns. The particles in the interior section have an average size of 1.7 microns. For comparison a representative sample of can stock made with AA3014 by a conventional DC casting route is shown in FIGS. 5A and 5B. The size of intermetallic particles on the surface and in the interior of the strip are similar. The intermetallics in this case are substantially transformed to alpha phase as is typical with DC cast material. The size of these particles is approximately 3.7 microns. FIGS. 6A and 6B show the distribution of intermetallic particles obtained in a typical prior art continuous cast can stock. The alloy used contained Si=0.13%, Fe=0.46%, Mg=1.85%, Mn=0.69%, Cu=0.08%, balance Al and unavoidable impurities, cast on a belt caster and hot and cold rolled using the method and described in U.S. Pat. No. 4,614,224. Most particles are alpha-phase, and are of similar sizes on the surface and interior. The size is typically about 1.5 microns.

The strip cast material of the present invention prepared in this example, was subjected to a D&I can making test. At least 50,000 can bodies were fabricated with little or no scoring of the surfaces. This performance is similar to that exhibited with DC cast material. The prior art strip cast material as described in this example was also run in a D&I operation. After about 1000 can bodies, scoring and scratching of the surface was observed, and the D&I operation could not be continued, indicating that debris had built up on the die surfaces.

EXAMPLE 2

Figure 7:
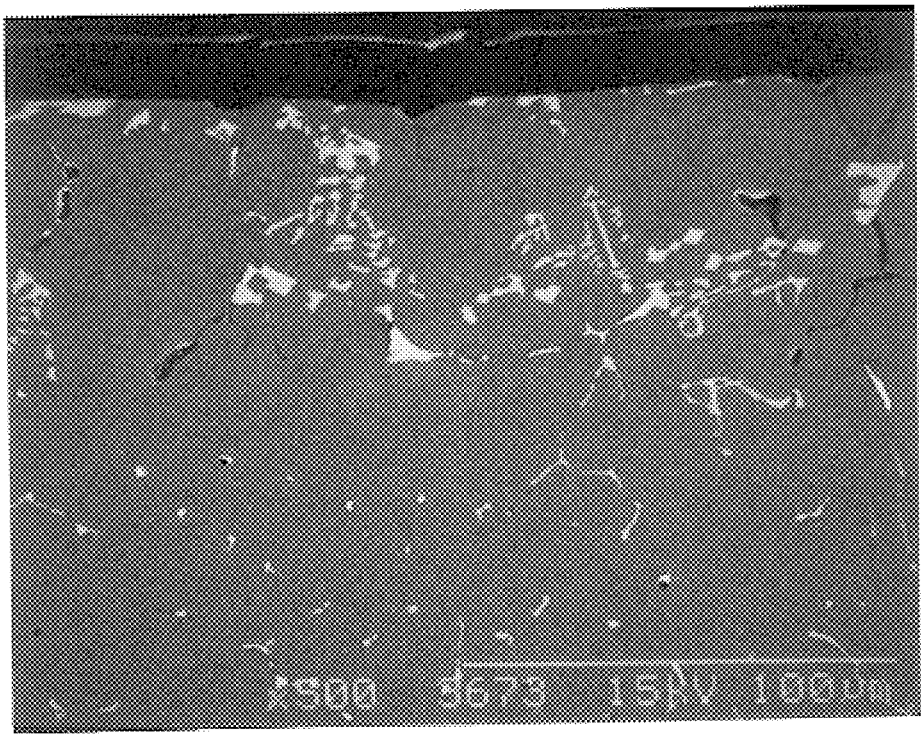
FIG. 7 is a micrograph showing a cross-section of cast strip near the surface of the strip prepared by a second embodiment of the present invention.

The alloy of the same composition as in Example 1 was cast on the same commercial belt caster, but used ceramic coated belts, produced by flame spraying and referred to as the Hazelett Matrix Y coating. The roughness ($R_a$) was 10.1 microns and the heat flux during initial solidification was 2 $MW/m^2$. FIG. 7 is an illustrative micrograph showing the cast slab in cross-section. A surface segregated layer about 60 microns in thickness may be observed, containing $(Fe,Mn)Al_6$ intermetallics having an average size (thickness) of 4.5 microns. The secondary dendrite arm spacing in the surface layer was 15.5 microns. In the bulk of the sample, the average size of particles (thickness) is about 2 microns.

EXAMPLE 3

Figure 8:
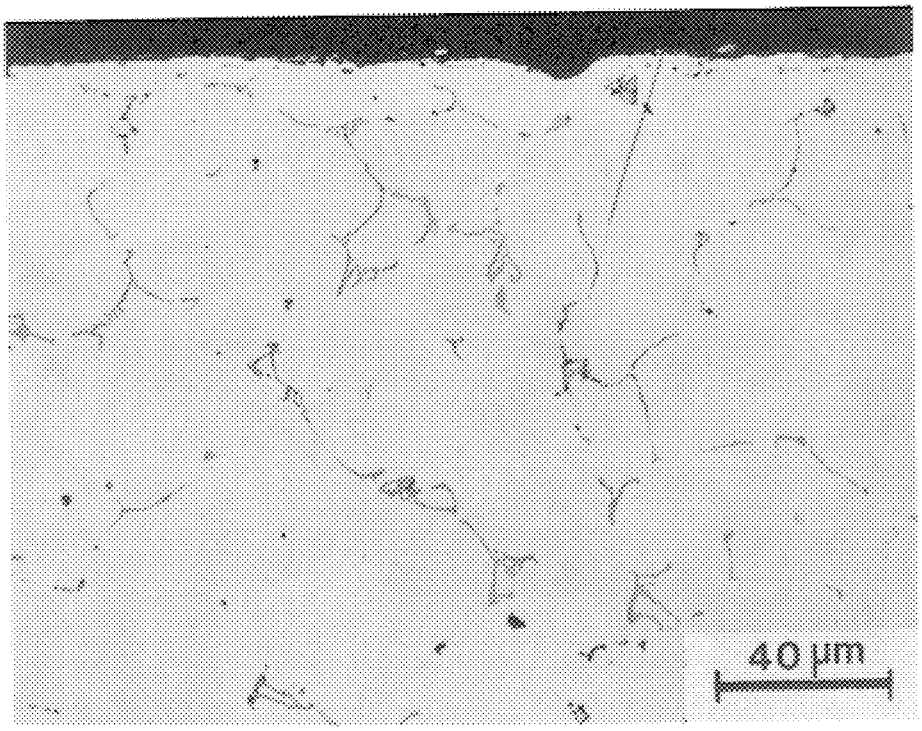
FIG. 8 is a micrograph showing a cross-section of cast strip prepared using a composition range and belt characteristics outside the range of the present invention.

An alloy having a composition of 0.2% Cu, 0.35% Fe, 1.41% Mg, 0.91% Mn, 0.21% Si, was cast on a pilot scale belt caster having "smooth" belts with roughness factor ($R_a$) of 1.27 microns and using a heat flux of 2.2 $MW/m^2$ during the solidification of the slab. FIG. 8 is an illustrative micrograph of a cross-section of the as cast slab. The intermetallics are alpha-phase, and there is no significant size difference (particle thickness) between the surface and the interior. The particle size (thickness) was about 1.5 microns. The secondary dendrite arm spacing at the surface was 14 microns. This is illustrative of the prior art continuous cast slab with Si outside the preferred range.

EXAMPLE 4

Figure 9:
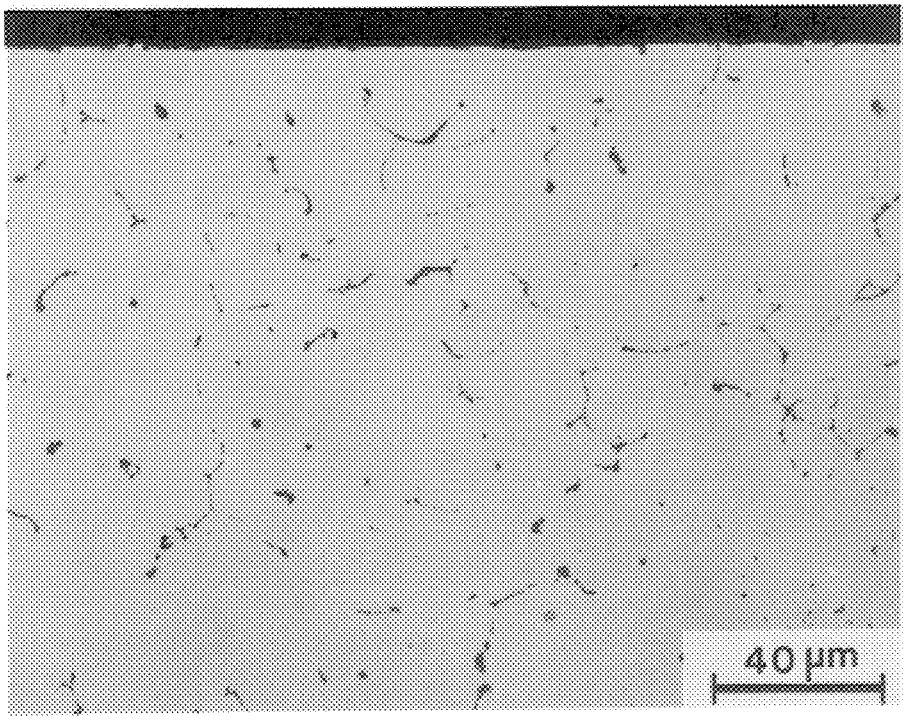
FIG. 9 is a micrograph showing a cross-section of cast strip prepared using a composition range within the present invention, but belt characteristics outside the range of the present invention.

An alloy similar to Example 3, except that the Si was 0.07% (lying within the preferred composition of the present invention) was cast on the same caster and belts as Example 3. This belt therefore had a roughness less than the preferred range of roughness. FIG. 9 is an illustrative micrograph. The intermetallics are $(Fe,Mn)Al_6$ and have a size (thickness) of about 1.7 microns. However, the size is uniform throughout the slab (no surface layer). The secondary dendrite arm spacing at the surface was 14 microns.

EXAMPLE 5

Figure 10:
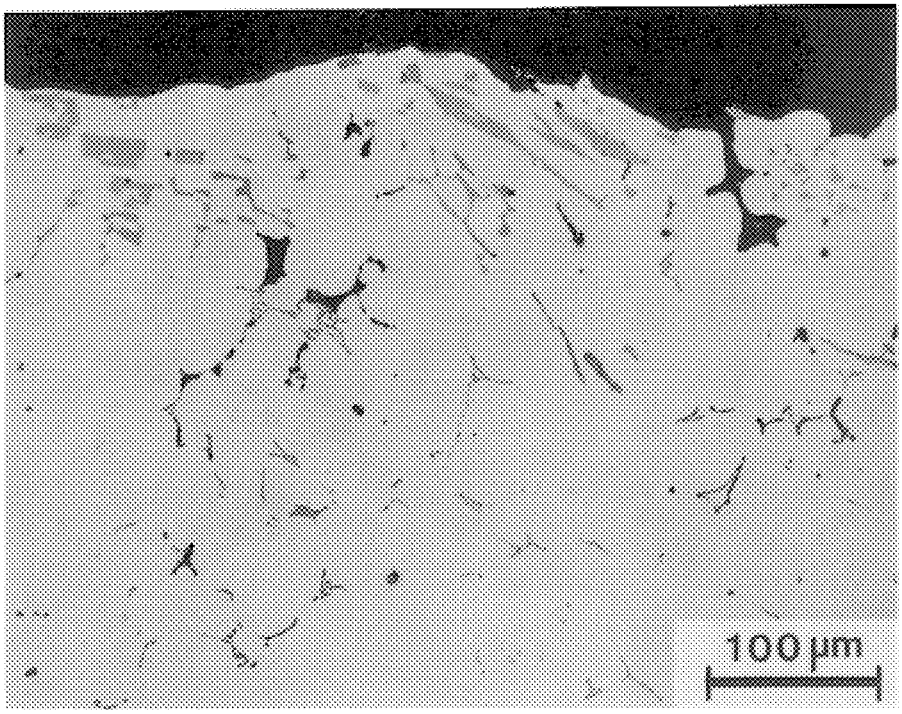
FIG. 10 is a micrograph showing a cross-section of cast strip prepared using a composition range within the present invention, and belt characteristics lying within the broad, but not preferred range of the present invention.

An alloy of the same composition as Example 1 was cast on a pilot scale belt caster having belts with a ceramic coating having a roughness factor ($R_a$) of 15.2 microns. This surface roughness lies within the broad range of the present invention, but not the preferred range. A heat flux of 0.8 $MW/m^2$ was used during the solidification. FIG. 10 is an illustrative micrograph. A surface segregated layer of 100 to 150 microns thick, containing $(Fe,Mn)Al_6$ intermetallics of average size (thickness) of 7.6 microns, whereas the intermetallics in the bulk region had an average thickness of about 2.4 microns. The surface segregated layer had a secondary dendrite arm spacing of about 18 microns. The surface segregated layer also had some surface porosity.

What we claim is:

1. A metallic strip article having a thickness of less than or equal to about 30 mm, and containing $(Mn,Fe)Al_6$ principal intermetallic particles with an average surface size at a surface of said strip and an average bulk size in a bulk of said strip, wherein said average surface size is greater than said average bulk size, said strip article having a composition which comprises, in addition to aluminum:

| | |
|---|---|
| Si | between 0.05 and 0.15% |
| Fe | between 0.3 and 0.6% |
| Mn | between 0.6 and 1.2% |
| Mg | between 1.1 and 1.8% |
| Cu | between 0.2 and 0.6%. |

2. An article as claimed in claim 1 wherein said principal intermetallic particles comprise at least 60% of all intermetallic particles present in said strip article.

3. An article as claimed in claim 1 wherein said average surface size is at least 1.5 times greater than said average bulk size.

4. A metallic strip article having a thickness of less than or equal to about 30 mm, and containing $(Mn,Fe)Al_6$ principal intermetallic particles with an average surface size at a surface of said strip and an average bulk size in a bulk of said strip, wherein said average surface size is greater than said average bulk size, said article having a composition which consists, in addition to aluminum, essentially by weight of:

| | |
|---|---|
| Si | between 0.05 and 0.15% |
| Fe | between 0.3 and 0.6% |
| Mn | between 0.6 and 1.2% |
| Mg | between 1.1 and 1.8% |
| Cu | between 0.2 and 0.6% |
| Cr | less than or equal to 0.03% |
| Zr | less than or equal to 0.03% |
| V | less than or equal to 0.03%. |

5. An article as claimed in claim 4 wherein the Mn lies between 0.7 and 1.2% by weight and Si between 0.07 and 0.13% by weight.

6. An article as claimed in claim 1 wherein said strip article is a continuously cast strip article having a thickness of between about 9 mm and about 25 mm, wherein said strip article has a surface segregated layer, and wherein the said average surface size is determined within said surface segregated layer and the said average bulk size is determined outside said surface segregated layer in a bulk layer of said strip article.

7. An article as claimed in claim, 6 having a secondary dendrite arm spacing at the surface of the said cast strip article of between 12 and 18 microns.

8. An article as claimed in claim 7 wherein said secondary dendrite arm spacing is between 14 and 17 microns.

9. An article as claimed in claim 6 wherein said intermetallics are present in larger average concentration in said surface segregated layer than in said bulk layer.

10. An article as claimed in claim 6 wherein said intermetallic particles in said surface segregated layer are about 2 to 15 microns in thickness and 10 to 100 microns in length.

11. An article as claimed in claim 6 wherein said surface segregated layer is about 10 to 60 microns in thickness.

12. An article as claimed in claim 1 wherein said strip article is substantially free of porosity.

13. An article as claimed in claim 1 wherein said strip article is a product of a continuous casting process in which molten alloy is cast between surfaces having a surface roughness of between 4 and 15 microns, said surface roughness being substantially in the form of sharp peaks.

14. An article as claimed in claim 13 wherein said continuous casting process is carried out in a twin belt caster.

15. An article as claimed in claim 1 wherein said strip article is in the form of a rolled strip article having a thickness of less than or equal to about 5 mm, and where said lesser average size of said intermetallic particles in said bulk are determined at a centre of said strip article.

16. An article as claimed in claim 1 wherein said intermetallics at said surface of said strip article have an average size of between 2 and 10 microns.

17. An article as claimed in claim 1 wherein said strip article has a thickness of between about 0.8 and about 5.0 mm and wherein said strip article is a product produced by hot rolling said strip article from cast alloy without an homogenization step.

18. An article as claimed in claim 1 wherein said strip article has a thickness of between about 0.26 and about 0.40 mm, and wherein said strip article is a product produced from cast alloy by a process comprising hot rolling without prior homogenization, followed by cold rolling.

19. An article as claimed in claim 18 wherein said cold rolling process is selected from the group consisting of: (a) an annealing step selected from the group consisting of batch annealing, self annealing and continuous annealing said strip after hot rolling but before cold rolling, then cold rolling to final gauge using a reduction of between 70 and 80%; and (b) cold rolling said strip article after hot rolling to an intermediate gauge, batch annealing or continuous annealing said strip article at an intermediate gauge, then cold rolling said strip article to final gauge using a reduction of between 45 and 70%.

20. An article as claimed in claim 19 wherein said batch annealing step comprises annealing said strip article at a temperature of between 400 and 450° C. for a period of time in the range of 0.25 to 6 hours.

21. An article as claimed in claim 19 wherein said continuous annealing step comprises heating said strip article product at between 500° C. and 550° C. for a period of time in the range of 10 to 180 seconds, then cooling said strip article to room temperature in a period of time less than 120 seconds.

22. An article as claimed in claim 19 wherein said self annealing step comprises coiling said strip article at a temperature of at least 400° C. to form a coil, and allowing said coil to cool to room temperature by natural cooling.

23. An article as claimed in claim 1 wherein the strip article has 45 degree earing of less than about 3%, elongation of greater than about 4%, and a yield strength after stoving at 195° C. for 10 minutes at least 36 ksi.

24. An article as claimed in claim 23 wherein said yield strength after stoving is at least 39 ksi.

25. A metallic strip article comprising aluminum and formed by a method comprising casting upon solidification from a melt, said article having a thickness of less than or equal to about 30 mm, and containing $(Mn,Fe)Al_6$ intermetallics as principal intermetallic particles in said strip formed during said solidification, said intermetallic particles having an average surface size at a surface of said strip and an average bulk size in a bulk of said strip, wherein said average surface size is greater than said average bulk size; and said strip comprising Si, Fe, Mn, Mg and Cu.

* * * * *